US005617825A

United States Patent [19]

Altmann et al.

[11] Patent Number: 5,617,825

[45] Date of Patent: Apr. 8, 1997

[54] THROTTLE DEVICE

[75] Inventors: Otto Altmann, Kirchseeon; Gerhard Brenner, Asperg, both of Germany

[73] Assignee: Filterwerk Mann & Hummel GmbH, Ludwigsburg, Germany

[21] Appl. No.: 602,771

[22] PCT Filed: Aug. 29, 1994

[86] PCT No.: PCT/EP94/02852

§ 371 Date: May 29, 1996

§ 102(e) Date: May 29, 1996

[87] PCT Pub. No.: WO95/06807

PCT Pub. Date: Mar. 9, 1995

[30] Foreign Application Priority Data

Sep. 2, 1993 [JP] Japan ..... 43 29 522.3

[51] Int. Cl.[6] ..... F02D 9/08

[52] U.S. Cl. ..... 123/337

[58] Field of Search ..... 123/337, 400, 123/403; 251/306, 357

[56] References Cited

U.S. PATENT DOCUMENTS

| | | | |
|---|---|---|---|
| 4,064,857 | 12/1977 | William | 123/141 |
| 5,035,214 | 7/1991 | Daly et al. | 123/337 |
| 5,158,045 | 10/1992 | Arthur et al. | 123/337 |
| 5,188,078 | 2/1993 | Tamaki | 123/337 |
| 5,216,992 | 6/1993 | Ropertz et al. | 123/337 |
| 5,374,031 | 12/1994 | Semence et al. | 251/305 |

FOREIGN PATENT DOCUMENTS

| | | | |
|---|---|---|---|
| 294083 | 12/1988 | European Pat. Off. | 123/337 X |
| 2606115 | 5/1988 | France | 123/337 X |
| 2422519 | 11/1975 | Germany | 123/337 X |
| 4010229 | 10/1991 | Germany | 123/337 X |
| 4202437 | 7/1992 | Germany | 123/337 X |
| 4133858 | 4/1993 | Germany | 123/337 X |
| 4209586 | 9/1993 | Germany | 123/337 X |
| 2248272 | 4/1992 | United Kingdom | 123/337 X |
| WO91/13245 | 9/1991 | WIPO | 123/337 X |

*Primary Examiner*—Raymond A. Nelli

*Attorney, Agent, or Firm*—Evenson, McKeown, Edwards & Lenahan P.L.L.C.

[57] ABSTRACT

A throttle device is described, in particular a throttle valve in a suction pipe of an internal-combustion engine. This throttle device consists of a housing, a throttle valve control, a position sensor and a throttle valve fastened to a throttle valve shaft. The throttle device is arranged between the clean-air-side air filter connection and the suction pipe of the internal-combustion engine. The air filter connection and/or the suction pipe consist of a plastic material, and the individual elements of the throttle device are constructed as modules which can be fitted, screwed or clamped together.

10 Claims, 2 Drawing Sheets

THROTTLE DEVICE

The invention relates to a throttle device according to the preamble of the main claim.

A throttle valve is known, for example, from European Patent Document EP 04 98 933 A1. It is integrated into a housing which can be fastened on a supporting body. The housing is constructed in the manner of a throttle valve connection piece; that is, the connection piece is fastened on one side to the supporting body and on the other side to the suction system of an internal-combustion engine.

A disadvantage of this throttle valve fastening is the fact that high component expenditures are required, and a larger number of sealing elements is necessary between the individual components.

Furthermore, from International Patent Document WO 91 05 152 a throttle device is known for reducing the charge cycle losses in the case of an internal-combustion engine. This throttle device is also a separate component which, on one side, must be connected to the suction system of an engine and, on the other side, must be connected to an air-carrying system.

A disadvantage of this known device are the high mounting expenditures as well as the large number of component parts which must be joined to form a unit when the throttle device is assembled. In contrast, in the course of the continuing reduction of components and of the optimization as well as the weight reduction in vehicle and automobile construction, there is the endeavor to produce complete systems which achieve this objective.

It is therefore an object of the invention to provide a throttle device which requires lower mounting expenditures and simplifies the servicing of the system. Based on the preamble of the main claim, this object is achieved by means of its characterizing features.

A significant advantage of the invention is the fact that the consequent use of plastic material in the area of the suction system of an internal-combustion engine is largely taken into account. Because of the lower modulus of elasticity, specifically plastic material partially causes much lower specific stress to the material as a result of the support surface considerably enlarged by deformation than in the case of steel pairings. In addition, synthetic material has further interesting features, such as resistance to corrosion, high mechanical damping, an extremely low friction coefficient, lower wear, a low specific weight, good processing capacities and low finished part costs in the case of mass production. Particularly the latter suitability of the plastic materials for a finishing at reasonable cost which is particularly striking during the injection molding of parts of a complicated design, makes the plastic materials superior to other materials.

Known throttle valves or throttle devices were normally constructed of metal and arranged between a plastic air filter and a plastic suction system. By means of the modular construction of the throttle valve, the assembling expenditures can be reduced considerably. In addition, the modular design permits an easy exchange of defective parts and a componentized manufacturing in the case of which, starting from a basic module, different components, according to the demand, can be combined with one another to form a throttle device.

An advantageous embodiment of the invention provides that the throttle valve be equipped with a shaft divided into two parts. This has the advantage of, in addition to facilitating the assembly, making it possible for two separate modules to be present on the shaft parts. This provides that the position sensor is arranged on one shaft portion and the adjusting unit is arranged on the other shaft portion.

A further embodiment of the invention provides that the throttle valve module is to be slid as a complete unit into an existing connection piece or is to be connected between two connection pieces. Thus, an additional throttle valve connection piece is avoided.

According to another embodiment of the invention, it is expedient to integrate the housing of the throttle valve module into a connection. This means that the connection element between an air filter outlet and a suction system inlet simultaneously forms the throttle valve module.

These and other characteristics of preferred embodiments of the invention, in addition to being described in the claims, are also indicated in the specification and the drawings, in which case the individual characteristics may each be implemented alone or as several characteristics in the form of subcombinations in the case of the embodiment of the invention and may be implemented in other fields and may represent advantageous embodiments as well as embodiments that can be protected separately for which a protection is claimed here.

In the following, the invention will be explained in detail by means of embodiments.

Figure 1:
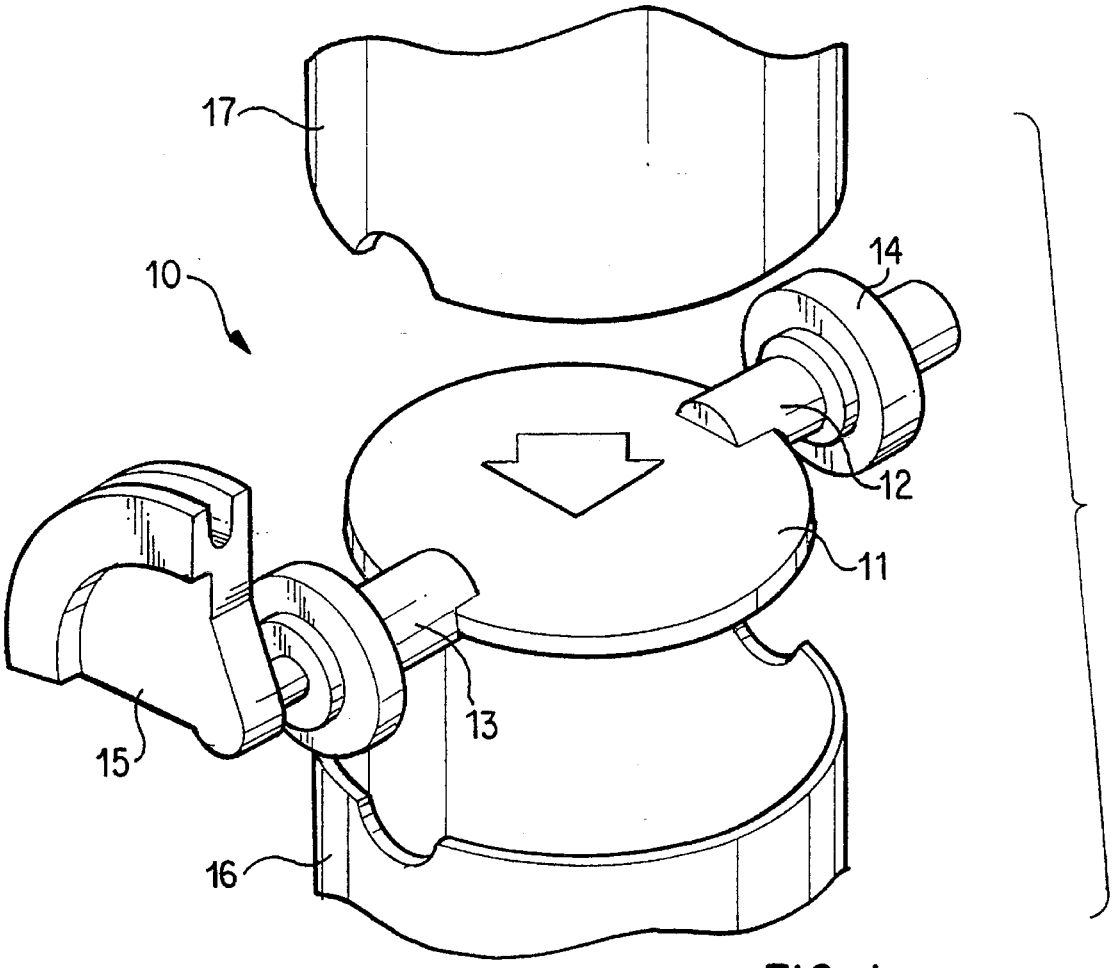
FIG. 1 is a view of a preassembled throttle valve mounting module.

The mounting module 10 according to FIG. 1 consists of a throttle valve 11 which is provided with two bearing parts 12, 13. On bearing part 12, a position tapping device or position sensor 14 is arranged; on bearing part 13, the receiving device 15 for the Bowden cable, which is not shown here, is provided. The whole mounting module 10 is hung into the connecting flange 16 of a suction pipe. A connecting flange 17, which represents the clean-air outlet of the air filter, is put over the mounting module 10 and thus, in connection with the connecting flange 16, forms the fastening device for the mounting module 10.

This mounting module can be sealed off particularly well. The connecting flange 16 or the connecting flange 17 may have a surrounding groove for a rubber sealing strip. The bearings and the additional seal may be preassembled as well as the throttle valve with the two lateral parts.

By means of this method of construction, the two connecting flanges 16, 17 may be constructed according to the system of constant wall thicknesses. By way of a detachable connecting technique, the mounting module may be replaced or repaired at any time.

The sealing of the throttle valve 11 in the connecting flange 16 takes place by suitable sealing beads which are arranged in the connecting flange 16 and on which the throttle valve rests in a sealing manner.

Figure 2:
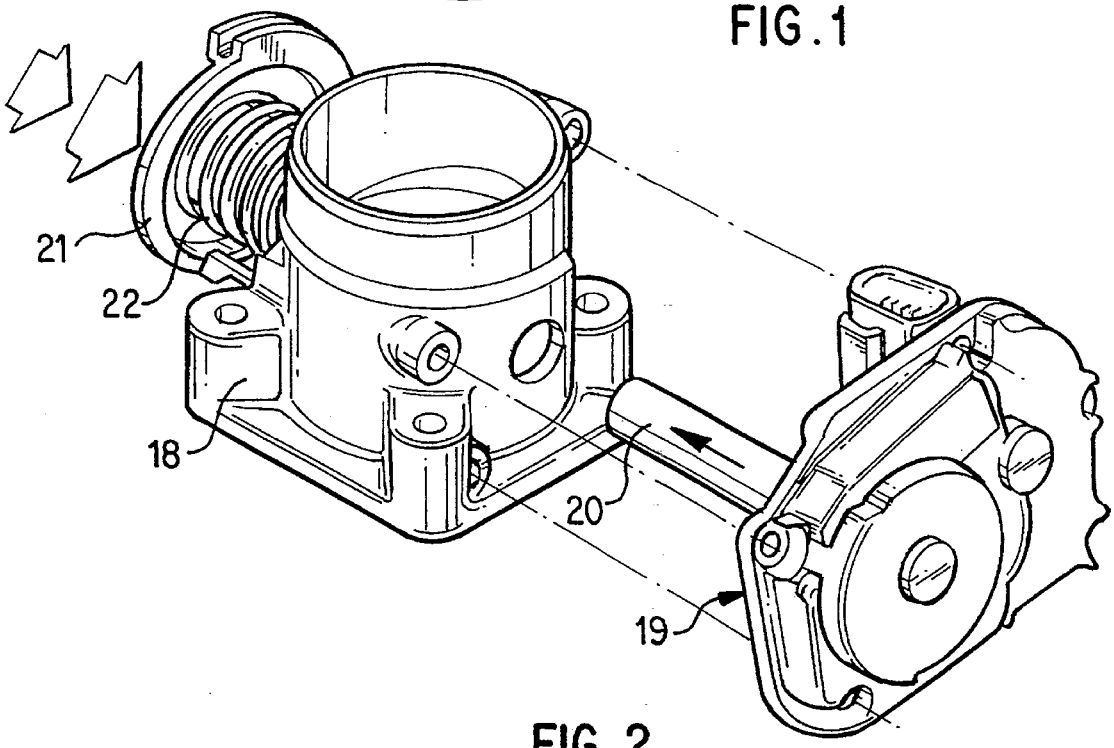
FIG. 2 is a view of a throttle valve plug-in module.

FIG. 2 illustrates a throttle valve plug-in module with divided throttle valve shafts. A throttle valve connection piece 18, which by means of suitable screwed connections, is connected to a suction system not shown here, consists of a plastic injection molded part. On this plastic injection molded part, a preassembled module 19 is fastened which contains position sensors and additional measuring devices as well as a half-shaft 20. On the opposite side of the control side for the throttle valve, the fastening device 21 for the Bowden cable, a restoring spring 22 as well as the other half-shaft not visible here are arranged. Before the assembling of these two modules, the throttle valve is inserted into the throttle valve connection piece 18 and is fixed on the half-shafts by the assembling of the two modules.

An advantage of this throttle valve plug-in module is the fact that the individual modules, such as the module 19, can be exchanged easily. In addition, for different series, the correspondingly adapted modules may be mounted in the manner of an assembly of prefabricated machine parts.

Figure 3:
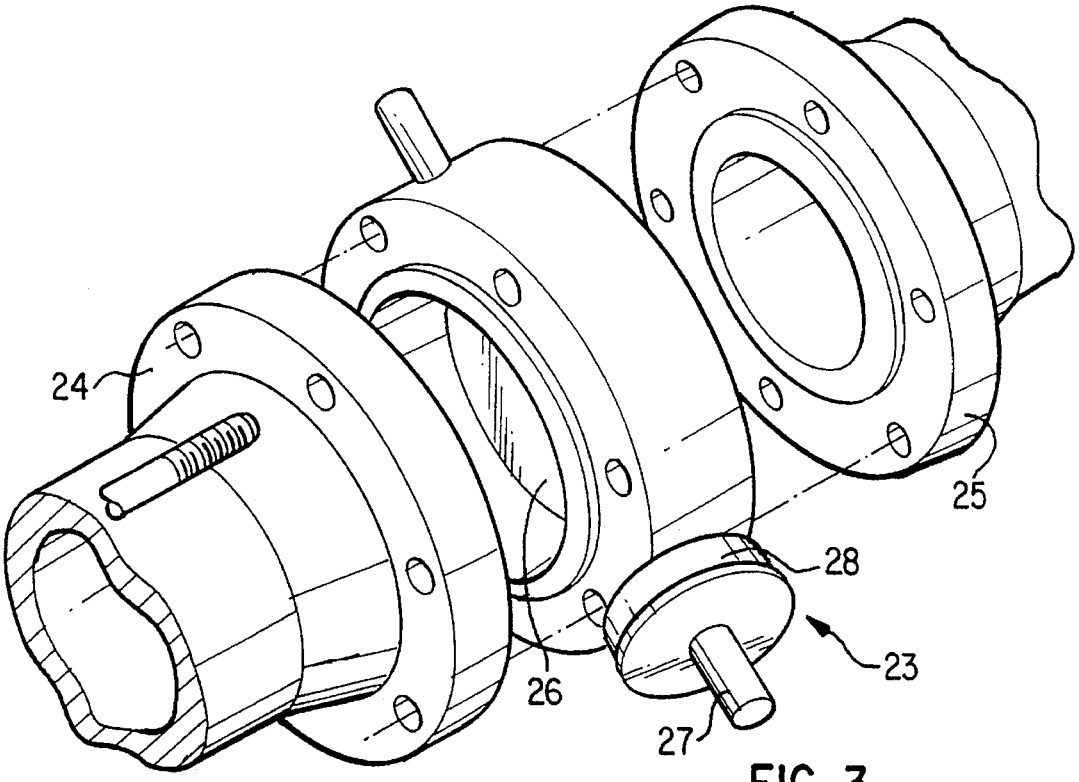
FIG. 3 is a view of a variant of a preassembled throttle valve module.

FIG. 3 illustrates a preassembled throttle valve module 23 which is fastened between connecting flange 24 and connecting flange 25. While connecting flange 25 represents the outlet side of the air filter, connecting flange 24 is connected with the suction pipe side of the engine. The throttle valve module 23 comprises the throttle valve 26 as well as the throttle valve shaft 27 and the bearing 28. The position sensors arranged on the shafts or the activating device for the throttle valve are not shown here.

Figure 4:
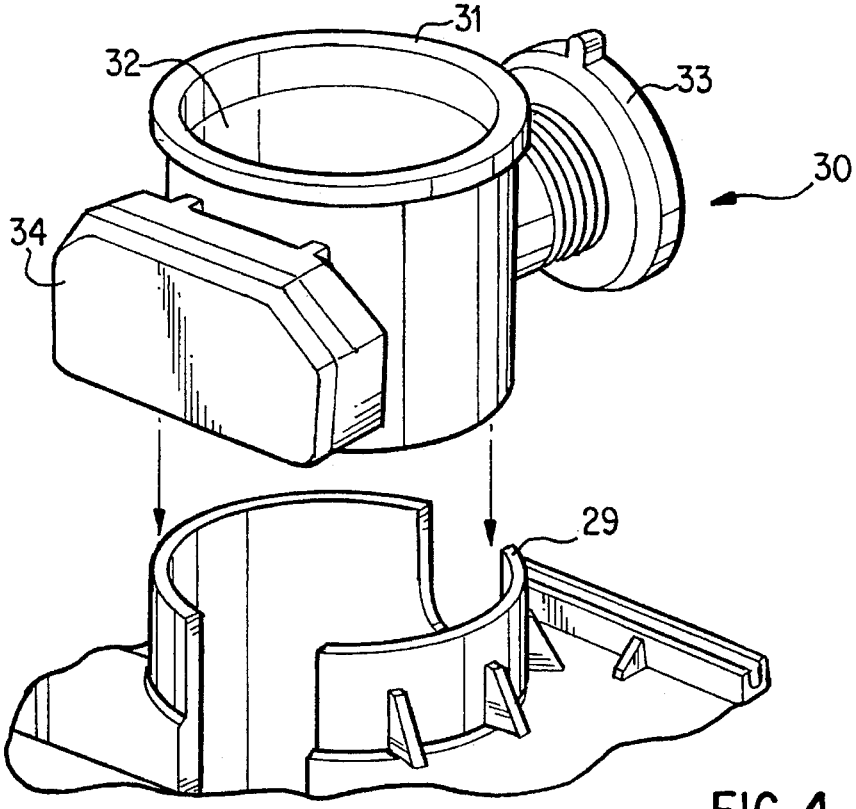
FIG. 4 is a view of a throttle valve slide-in module.

FIG. 4 illustrates a throttle valve slide-in module which is fitted into a suction system connection piece 29. This throttle valve slide-in module 30 consists of a throttle valve connection piece 32 in which the throttle valve 32 is arranged. On one side of the plug-in module 30, a position generator 33 is situated; on the opposite side, the position sensor 34 is situated.

This slide-in module has the advantage that different constructions may be installed in the existing space without the requirement of changing the module concept. The pre-assembled throttle valve slide-in module is connected by way of a suitable sealing system with the suction system connection piece 29. This version also has the advantage that the whole module can be exchanged very rapidly.

We claim:

1. A throttle device comprising a housing, a throttle valve mounted on a throttle valve shaft in said housing, a throttle valve position control and a position sensor, said throttle device being arranged between a filtered air outlet of an air filter and an intake manifold of an internal-combustion engine, wherein at least one of said filtered air outlet and said intake manifold are formed of synthetic resin material, and the housing, the throttle valve, the valve shaft, the position control and the position sensor are constructed as modules which can be friction fitted, screwed or clamped together.

2. A throttle device according to claim 1, wherein said throttle valve of the throttle device is installed in the intake manifold of the internal-combustion engine.

3. A throttle device according to claim 1, wherein the housing is formed of synthetic resin material.

4. A throttle device according to claim 1, wherein the throttle valve is formed of synthetic resin material.

5. A throttle device according to claim 1, wherein the housing and the throttle valve are formed of synthetic resin material.

6. A throttle device according to claim 1, wherein said throttle valve shaft is divided into two shaft parts, the position sensor module is arranged on one of said shaft parts, and the valve control module is arranged on the other of said shaft parts.

7. A throttle device according to claim 1, wherein the throttle valve, valve position control and position sensor modules form a unit with the valve shaft, said unit being arranged the filtered air outlet of the air filter and the inlet of the intake manifold.

8. A throttle device according to claim 7, wherein said unit is received in the filtered air outlet of the air filter.

9. A throttle device according to claim 7, wherein said unit is received in the inlet of the intake manifold.

10. A throttle device according to claim 1, wherein the housing is integrated in the filtered air outlet of the air filter or in the inlet of the intake manifold.

* * * * *